United States Patent [19]

Noguchi et al.

[11] Patent Number: 4,877,006

[45] Date of Patent: Oct. 31, 1989

[54] AIR-FUEL RATIO CONTROL METHOD FOR INTERNAL COMBUSTION ENGINES

[75] Inventors: Kunio Noguchi; Yuzuru Koike; Kazushige Toshimits, all of Wako, Japan

[73] Assignee: Honda Giken Kogyo K.K., Tokyo, Japan

[21] Appl. No.: 239,786

[22] Filed: Sep. 1, 1988

[30] Foreign Application Priority Data

Sep. 8, 1987 [JP] Japan ..... 62-224803

[51] Int. Cl.[4] ..... F02M 23/04

[52] U.S. Cl. ..... 123/589; 123/489

[58] Field of Search ..... 123/440, 478, 480, 486, 123/489, 589

[56] References Cited

U.S. PATENT DOCUMENTS

| | | | |
|---|---|---|---|
| 4,558,682 | 12/1985 | Hasegawa et al. | 123/589 |
| 4,604,984 | 8/1986 | Isobe et al. | 123/589 |
| 4,617,900 | 10/1986 | Kobayashi et al. | 123/589 X |
| 4,677,959 | 7/1987 | Suzuki et al. | 123/589 X |
| 4,694,805 | 9/1987 | Yatabe et al. | 123/489 |
| 4,730,594 | 3/1988 | Hibino et al. | 123/589 |
| 4,751,906 | 6/1988 | Yatabe et al. | 123/489 |
| 4,765,305 | 8/1988 | Hibino et al. | 123/589 |

FOREIGN PATENT DOCUMENTS 0160528 9/1983 Japan .

*Primary Examiner*—Willis R. Wolfe

*Attorney, Agent, or Firm*—Arthur L. Lessler

[57] ABSTRACT

A method of controlling the air-fuel ratio of a mixture of fuel supplied to an internal combustion engine. Feedback control is effected to response to an output from an exhaust-gas concentration sensor to bring the air-fuel ratio to a predetermined value when the engine is in a predetermined medium-load operating region. It is determined whether or not the engine is in a predetermined high-load operating region in which the feedback control is interrupted for bringing the air-fuel ratio to a value smaller than the predetermined value, and whether or not the engine is in a predetermined low-load operating region in which the feedback control is interrupted for bringing the air-fuel ratio to a value larger than the predetermined value. The feedback control is effected even when the engine is in the predetermined low-load operating region, if the engine continually stayed over a first predetermined time period in the predetermined high-load operating region, and has shifted to the low-load operating region within a second predetermined time period after leaving the predetermined high-load operating region.

12 Claims, 7 Drawing Sheets

| FIG. 2A |
|---|
| FIG. 2B |

AIR-FUEL RATIO CONTROL METHOD FOR INTERNAL COMBUSTION ENGINES

BACKGROUND OF THE INVENTION

The present invention relates to an air-fuel ratio control method for internal combustion engines, and more particularly to a method of controlling the air-fuel ratio of a mixture of fuel supplied to an internal combustion engine when the engine has shifted from a high-load operation to a low-load operation.

Conventionally, an air-fuel ratio control method for internal combustion engines is known, e.g., from Japanese Provisional Patent Publication (Kokai) No. 58-160528, which controls the air-fuel ratio of a mixture supplied to the engine so as to improve the fuel consumption and emission characteristics, etc., of the engine, by sensing the concentration of an ingredient of exhaust gases emitted from the engine by means of an exhaust-gas concentration sensor provided in the exhaust system of the engine, effecting feedback control in response to the sensed ingredient concentration to bring the air-fuel ratio to a desired set value, and interrupting the feedback control during engine operation under particular operating conditions and effecting open-loop control to bring the air-fuel ratio to set values different from the above desired set value but respectively suitable for the particular operating conditions.

According to the conventional control method, as the engine shifts from the high-load operation to the low-load operation, three kinds of control are sequentially effected, as shown in FIG. 8. That is, open-loop control is first effected to decrease the air-fuel ratio to a value smaller than the above desired set value provided for feedback control, for enriching the mixture in a high-load operating region, i.e., a wide-open-throttle region, feedback control is then effected in a medium-load operating region, i.e., a feedback control region, and open-loop control is effected to increase the air-fuel ratio to a value larger than the above desired set value, for leaning the mixture in a low-load operating region, i.e., a mixture leaning region, in the mentioned order. In the mixture leaning region, the supply of fuel to the engine is interrupted (fuel cut) when a predetermined operating condition of the engine is satisfied.

However, the method has a disadvantage if the above sequential control is effected when the engine shifts from the wide-open-throttle region to the mixture leaning region in a brief time after a long-term staying in the wide-open-throttle region. That is, while mixture-enriching control has been effected for a long time period in the wide-open-throttle region, a large amount of fuel adheres to the inner wall of the intake pipe, throttle valve, etc. The fuel still adhering to the inner wall, etc. at the departure from the wide-open-throttle region is little drawn into combustion chambers while the engine is passing the feedback control region, because the engine stays in the feedback control region for a short period of time. Thus, most of the fuel remains within the intake pipe even after the engine has then shifted to the mixture leaning region. However, once the engine has shifted to the mixture leaning region, the adhering fuel is drawn in large quantities into the combustion chambers due to a decrease in absolute pressure within the intake pipe, whereas, in the mixture leaning region, the throttle valve is fully closed or slightly opened and hence the intake air introduced into the intake pipe is small in amount. Consequently, a very overrich mixture is supplied into the combustion chambers. As a result, part of the mixture will not be burnt within the combustion chambers, and the unburnt fuel is emitted from the combustion chambers into the engine exhaust system, thereby causing so-called after-fire within the exhaust system. Particularly, if the engine is provided with a three-way catalyst as an exhaust-gas purifying device in the exhaust system, such after-fire causes excessive rise of the temperature of the three-way catalyst, thereby deteriorating the performance of same and hence shortening the service life thereof. On the other hand, even if the entire mixture is burnt within the combustion chambers, the mixture which is overrich as stated above causes increase of CO and/or HC ingredients in the exhaust gases and hence degrade the emission characteristics.

Particularly, in an engine of a type having fuel injection valves arranged both upstream and downstream of the throttle valve, the intake pipe has a long span between the injecting location of the upstream valve and the combustion chambers so that the amount of fuel adhering to the intake pipe etc. becomes considerably large, thus making the above problem more serious.

SUMMARY OF THE INVENTION

It is the object of the invention to provide an air-fuel ratio control method for internal combustion engines, which is capable of preventing a mixture supplied to the engine from being overrich when the engine has shifted from a high-load operation to a low-load operation, thereby preventing after-fire and hence deteriorated performance of the three-way catalyst, and improving the emission characteristics.

To attain the above object, the present invention provides a method of controlling the air-fuel ratio of a mixture of fuel supplied to an internal combustion engine having an exhaust system and an exhaust-gas concentration sensor provided in the exhaust system, wherein feedback control is effected in response to an output from the exhaust-gas concentration sensor to bring the air-fuel ratio to a predetermined value when the engine is in a predetermined medium-load operating region.

The method is characterized by comprising the steps of:

(1) determining whether or not the engine is in a predetermined high-load operating region in which the feedback control is interrupted for bringing the air-fuel ratio to a value smaller than the predetermined value;

(2) determining whether or not the engine is in a predetermined low-load operating region in which the feedback control is interrupted for bringing the air-fuel ratio to a value larger than the predetermined value; and (3) effecting the feedback control even when the engine is in the predetermined low-load operating region, if the engine continually stayed over a first predetermined time period in the predetermined high-load operating region, and has shifted to the low-load operating region within a second predetermined time period after leaving the predetermined high-load operating region.

Preferably, the step (3) may be executed when pressure within the intake passage of the engine was continually equal to or higher than a predetermined value over the first predetermined time period in the predetermined high-load operating region.

Further, the predetermined value of the pressure within the intake passage may be determined by the rotational speed of the engine and/or atmospheric pressure.

The above and other objects, features and advantages of the invention will be more apparent from the ensuing detailed description taken in conjunction with the accompanying drawings.

DETAILED DESCRIPTION

The invention will now be described in detail with reference to the drawings showing an embodiment thereof.

Figure 1:
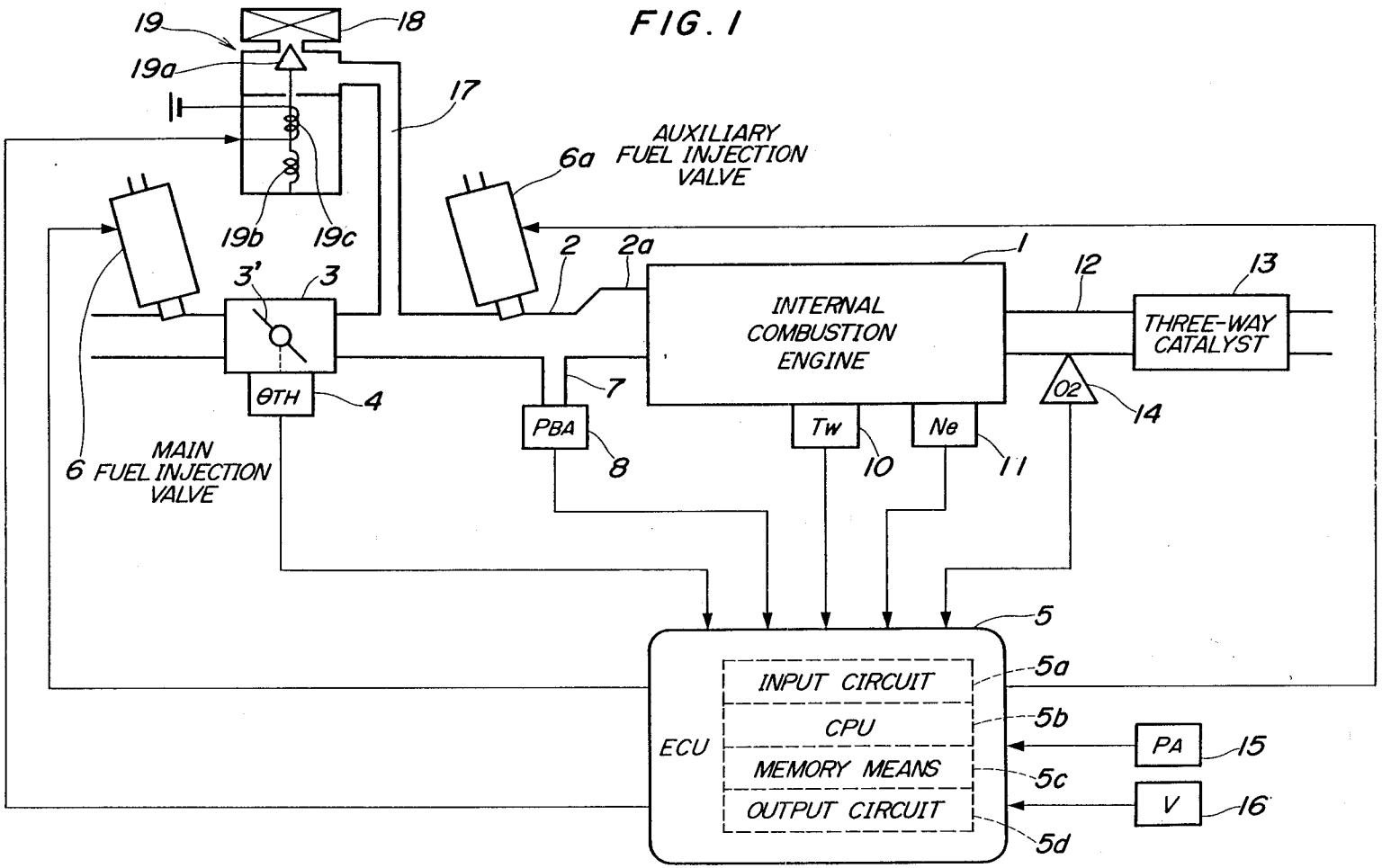
FIG. 1 is a block diagram showing the overall arrangement of a fuel supply control system for an internal combustion engine to which is applied an air-fuel ratio control method according to the present invention.

Referring first to FIG. 1, there is illustrated the whole arrangement of a fuel supply control system for an internal combustion engine, to which the method according to the invention is applied. In the figure, reference numeral 1 designates an internal combustion engine which may be a four-cylinder type, for instance. An intake pipe 2 is connected to the engine 1, which is formed by a diversified portion 2a having diverse pipes connected to respective cylinders and a united portion 2b to which the diverse pipes are joined. In the united portion 2b of the intake pipe 2 is arranged a throttle body 3 internally provided with a throttle valve 3'. A throttle valve opening sensor 4 (hereinafter called "the $\theta_{TH}$ sensor") is connected to the throttle valve 3' to supply an electrical signal indicative of the opening $\theta_{TH}$ of the throttle valve 3' to an electronic control unit (hereinafter referred to as "the ECU") 5.

A main fuel injection valve 6 is provided in the united portion 2b of the intake pipe 2 at a location upstream of the throttle body 3 to supply fuel to all the cylinders of the engine 1 when the engine 1 is in an operating condition other than idling. An auxiliary fuel injection valve 6a is provided in the united portion 2b of the intake pipe 2 at a location downstream of the throttle body 3 to supply fuel to all the cylinders of the engine 1 when the engine is in a warmed-up idling condition.

An air passage 17 is connected to the united portion 2b of the intake pipe 2 at a location between the auxiliary fuel injection valve 6a and the throttle body 3 and communicates the interior of the intake pipe 2 with the atmosphere. The air passage 17 has one end thereof opening to the atmosphere and having an air cleaner 18 mounted thereon. An auxiliary air control valve 19 is arranged across the air passage 17. The auxiliary air control valve 19 is a normally closed type proportional electromagnetic valve which comprises a valve body 19a disposed to vary the opening area of the air passage 17 in a continuous manner, a spring 19b urging the valve body 19a in a direction of closing same, and a solenoid 19c for moving the valve body 19a against the force of the spring 19b in a direction of opening the valve 19 when energized. The amount of current to be supplied to the auxiliary air control valve 19 is controlled by the ECU 5 such that the air passage 17 has an opening area conforming to operating conditions of the engine and load on the engine.

An absolute pressure sensor (hereinafter referred to as "the $P_{BA}$ sensor") 8 for detecting absolute pressure $P_{BA}$ within the intake pipe 2 is connected through a pipe 7 to the interior of the intake pipe 2 at a location downstream of the auxiliary fuel injection valve 6a. The $P_{BA}$ 8 gives an electric signal representing the detected absolute pressure $P_{BA}$ to the ECU 5.

An engine coolant temperature sensor (hereinafter referred to as "the $T_W$ sensor") 10, which may be formed of a thermistor or the like, is mounted in the cylinder block of the engine 1 in a manner embedded in the peripheral wall of an engine cylinder having its interior filled with coolant, detects engine coolant temperature ($T_W$) and supplies an electrical signal indicative of the detected engine coolant temperature to the ECU 5. An engine rotational speed sensor (hereinafter referred to as "the Ne sensor") 11 is arranged in facing relation to a camshaft, not shown, of the engine 1 or a crankshaft of same, not shown. The Ne sensor is adapted to generate a pulse of a top-dead-center position (TDC) signal (hereinafter referred to as "the TDC signal") at one of particular crank angles of the engine, i.e., at a crank angle position of each cylinder which comes a predetermined crank angle earlier relative to the top-dead-center position (TDC) at which the suction stroke thereof starts, whenever the engine crankshaft rotates through 180 degrees. The pulse generated by the Ne sensor is supplied to the ECU 5.

A three-way catalyst 13 is arranged in an exhaust pipe 12 extending from the cylinder block of the engine 1 for purifying ingredients HC, CO, and NOx contained in the exhaust gases. An $O_2$ sensor 14 as sensor means for sensing the concentration of an exhaust gas ingredient is inserted in the exhaust pipe 12 at a location upstream of the three-way catalyst 13 for detecting the concentration of oxygen ($O_2$) in the exhaust gases and supplying an electrical signal indicative of the detected oxygen concentration to the ECU 5. Further connected to the ECU 5 are an atmospheric pressure ($P_A$) sensor 15 for detecting atmospheric pressure and a vehicle speed (V) sensor 16 for detecting the speed of a vehicle in which the engine is installed, respectively for supplying an electrical signal indicative of the detected atmospheric pressure and an electrical signal indicative of the detected vehicle speed to the ECU 5.

The ECU 5 comprises an input circuit 5a which shapes the respective waveforms of input signals received from some of the sensors, adjust the respective voltages of signals from other sensors to a predetermined level and converts the respective analog values of the voltage-adjusted input signals to corresponding digital values, a central processing unit (hereinafter referred to as "the CPU") 5b, a memory unit 5c which stores programs to be executed by the CPU 5b and results of operations executed by the CPU 5b, and an output circuit 5d which gives driving signals to the main fuel injection valve 6, the auxiliary fuel injection valve 6a, and the auxiliary air control valve 19.

The CPU 5b operates in response to various engine operating parameter signals stated above, to determine operating conditions or operating regions in which the engine is operating, such as an air-fuel ratio feedback control region and an open-loop control region, based on a control program of FIG. 2, hereinafter described, and then to calculate the fuel injection period $T_{OUTM}$ for which the main fuel injection valve 6 should be opened in accordance with the determined operating conditions or regions of the engine and in synchronism with generation of pulses of the TDC signal, by the use of the following equation (1).

$$T_{OUTM}=T_{iM}\times K_{O2}\times K_{WOT}\times K_{LS}\times K_{TW}\times K_{AST}\times K_1+K_2 \quad (1)$$

where TiM represents a basic value of the valve opening period for the main fuel injection valve 6, which is determined from the engine rotational speed Ne and the intake pipe absolute pressure $P_{BA}$, for example. $K_{O2}$ represents an $O_2$-feedback correction coefficient, the value of which is calculated in response to an output signal from the $O_2$ sensor 14 representing the actual oxygen concentration in the exhaust gases during engine operation in the feedback control region. The correction coefficient $K_{O2}$ has its value set to and held at a predetermined value (e.g., 1.0, or an average value $K_{REF}$ of $K_{O2}$ values each applied upon generation of each pulse of the TDC signal when the engine 1 is in the feedback control region) when the engine 1 is in an open-loop control region.

$K_{WOT}$ is a mixture-enriching coefficient which is set to a predetermined value larger than 1.0 when the engine 1 is in the wide-open-throttle region or high-load operating region. $K_{LS}$ is a mixture-leaning coefficient which is set to a predetermined value smaller than 1.0 when the engine 1 is in the mixture leaning region or low-load operating region.

$K_{TW}$ is an engine coolant temperature-dependent correction coefficient, which has its value determined by engine coolant temperature $T_W$. $K_{AST}$ is an after-start fuel increasing the amount of fuel immediately after starting of the engine 1.

$K_1$ and $K_2$ are other correction coefficients and correction variables, respectively, calculated on the basis of engine operating parameters by using respective predetermined arithmetic expressions, to such values as optimize operating characteristics of the engine such as startability, exhaust emission characteristics, fuel consumption and engine accelerability.

The CPU 5b supplies a driving signal to the main fuel injection valve 6 through the output circuit 5d to open same over the fuel injection period $T_{OUTM}$ calculated as above.

Figure 5:
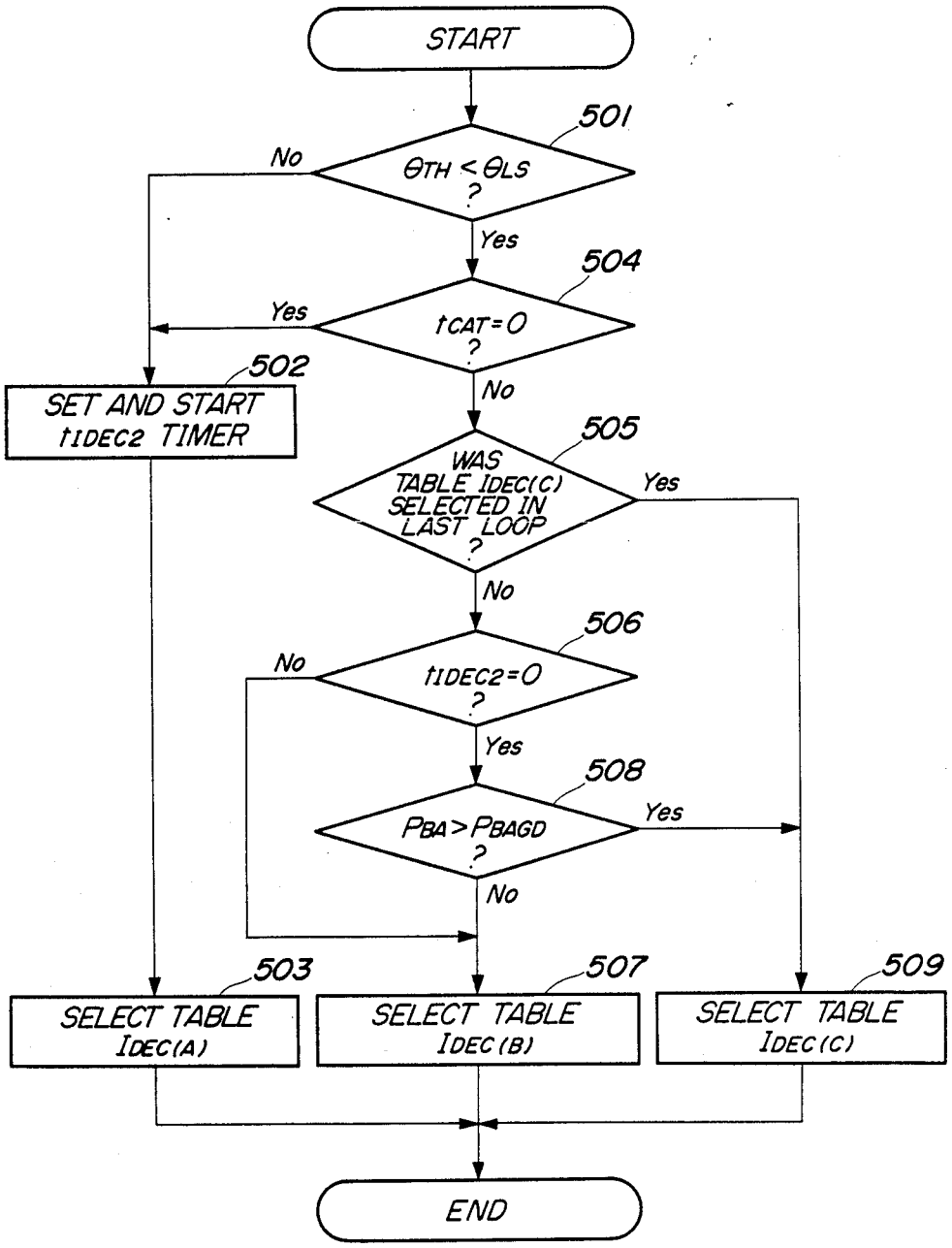
FIG. 5 is a flowchart of a subroutine for calculating an amount of electric current $I_{DEC}$ to be supplied to an auxiliary air control valve.

The CPU 5b operates in response to various engine operating parameter signals stated above supplied through the input circuit 5a whenever each pulse of the TDC signal is inputted thereto, to calculate an amount of current $I_{DEC}$ to be supplied to the solenoid 19c of the auxiliary air control valve 19 on the basis of a control program shown in FIG. 5 and supplies a driving signal based upon electric supply amount $I_{DEC}$ thus calculated to the auxiliary air control valve 19 through the output circuit 5d.

Incidentally, the CPU 5b executes control of fuel supply through the auxiliary fuel injection valve 6a to the engine 1 when the engine 1 is at idle, description thereof being omitted.

Figure 2A:
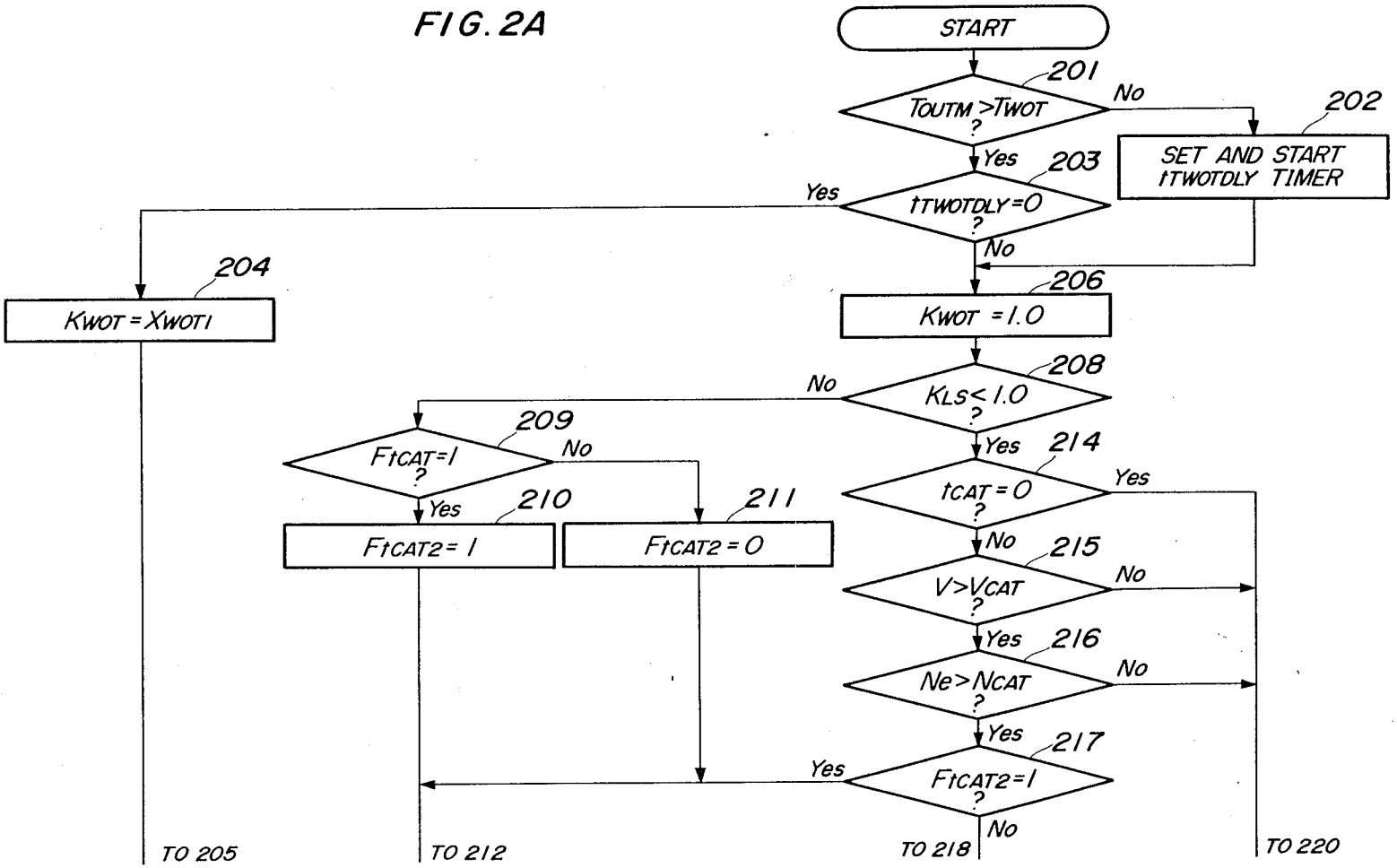
FIGS. 2, 2A and 2B are a flowchart of a control program for executing the method of the invention.
Figures 2, 2B:
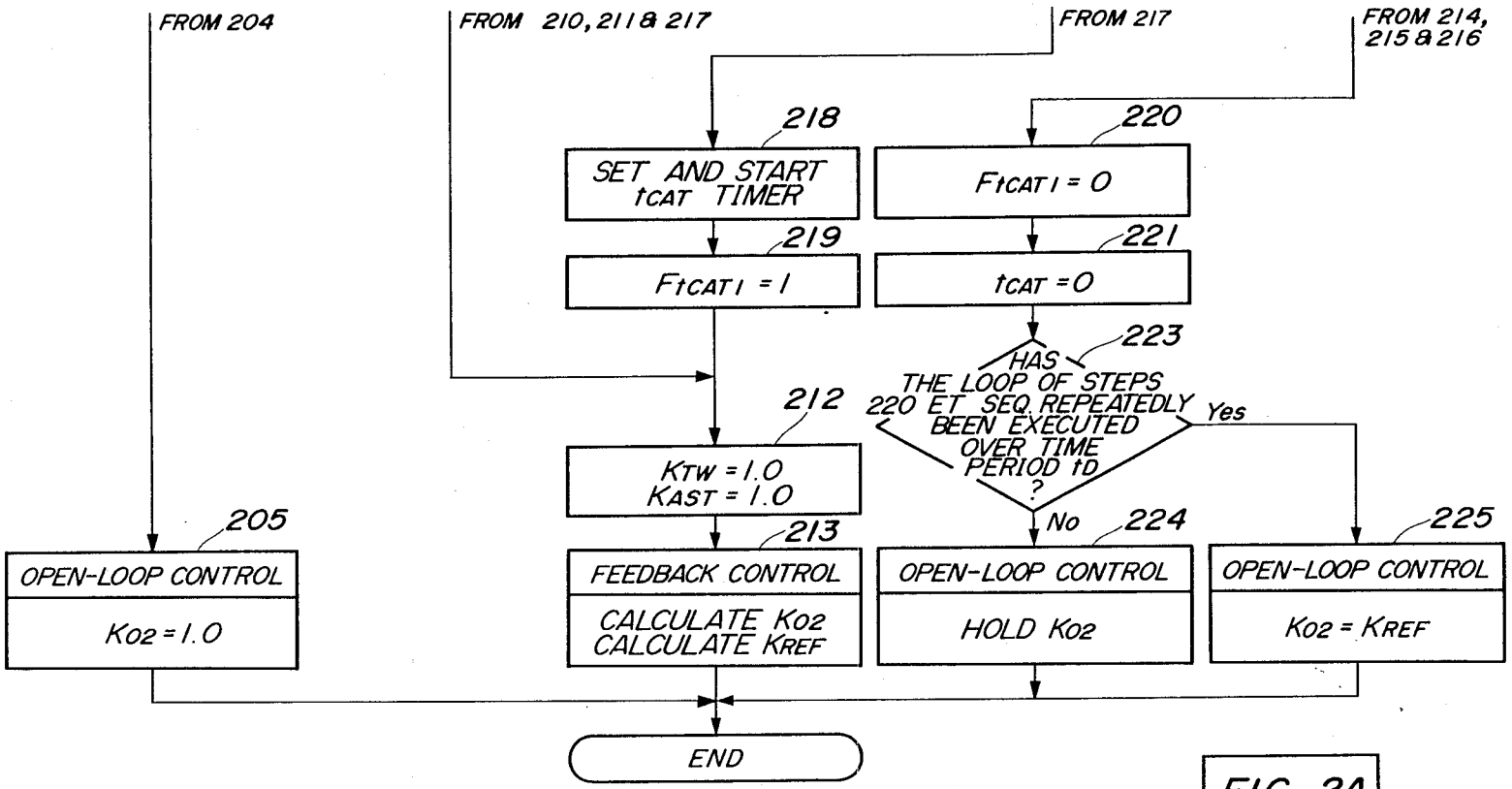

FIG. 2 shows a control program for carrying out the air-fuel ratio control according to the invention, which is executed upon generation of each pulse of the TDC signal.

First, at a step 201, it is determined whether or not the fuel injection period $T_{OUTM}$ is larger than a predetermined time period $T_{WOT}$ (e.g., 8 milliseconds), i.e., whether or not the engine 1 is in the wide-open-throttle region. If the answer to the question is negative or No, that is, if $T_{OUTM} \leqq T_{WOT}$ is satisfied, a $t_{TWOTDLY}$ timer as a down counter is started to count a predetermined time period value $t_{TWOTDLY}$ (e.g., 6 seconds) at a step 202, and the program proceeds to a step 206, hereinafter described.

If the answer to the question of the step 201 is affirmative or Yes, that is, if $T_{OUTM} > T_{WOT}$ is satisfied, it is determined at a step 203 whether or not the counted value of the $t_{TWOTDLY}$ timer, which has been started at the step 202, is equal to 0. If the answer is affirmative or Yes, that is, if the predetermined time period $t_{TWOTDLY}$ has elapsed after the engine 1 shifted to the wide-open-throttle region, the mixture-enriching coefficient $K_{WOT}$ is set to a value $X_{WOT1}$ larger than 1.0 at a step 204. The value $X_{WOT1}$ is determined by the engine rotational speed Ne and the throttle opening degree $\theta_{TH}$, for example. Then, at a step 205, the $O_2$-feedback correction coefficient $K_{O2}$ is set to 1.0 to thereby effect open-loop control for enriching the mixture supplied to the engine 1.

If the answer to the question of the step 203 is negative or No, that is, if the counted value $t_{TWOTDLY}$ is not equal to 0, the program proceeds to the step 206, wherein the mixture-enriching coefficient $K_{WOT}$ is set to 1.0. Thus, when the engine 1 has shifted to the wide-open-throttle region, the enrichment of the mixture by the coefficient $K_{WOT}$ is not effected until the predetermined time period $t_{TWOTDLY}$ elapses after the shifting. By doing so, when the engine operating state fluctuates into and out of the wide-open-throttle region, the air-fuel ratio control can stably be carried out without being affected by the fluctuations.

Figure 3:
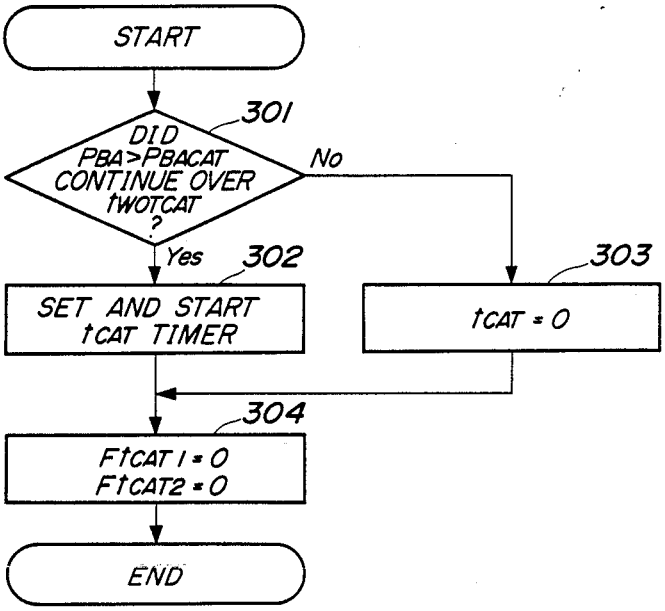
FIG. 3 is a flowchart of a subroutine for actuating a $t_{CAT}$ timer.

FIG. 3 shows a subroutine for actuating a $t_{CAT}$ timer, which is to be applied to a determination at a step 214, hereinafter described. This subroutine is executed upon generation of each pulse of the TDC signal when the engine 1 is in the wide-open-throttle region.

In the subroutine, it is first determined at a step 301 whether or not the intake pipe absolute pressure $P_{BA}$ has continually been higher than a predetermined value $P_{BACAT}$ over a first predetermined time period $t_{WOTCAT}$. This step is for determining the time period over which a state that fuel is apt to adhere to the inner wall of the intake pipe etc. has lasted in the wide-open-throttle region, to thereby presume whether or not a large amount of fuel adheres to the inner wall of the intake pipe, etc. immediately after the engine 1 leaves the wide-open-throttle region.

Figure 4:
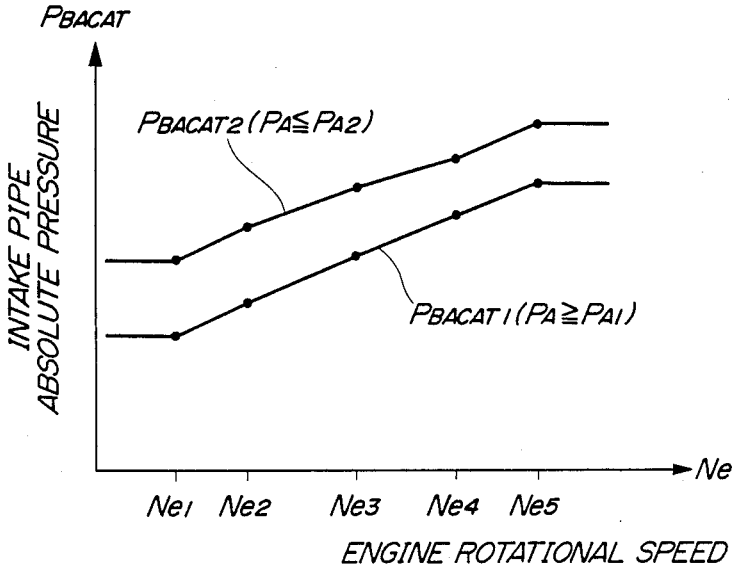
FIG. 4 is a graph showing tables of the relationship between a predetermined value $P_{BACAT}$, engine rotational speed Ne, and atmospheric pressure $P_A$, which are applied to the subroutine of FIG. 3.

FIG. 4 shows a $P_{BACAT}$ Table for setting the predetermined value $P_{BACAT}$ based upon the engine rotational speed Ne and the atmospheric pressure $P_A$. To be specific, the predetermined value $P_{BACAT}$ is set such that the higher the engine rotational speed Ne the larger the $P_{BACAT}$ value. Five $P_{BACAT1}$ values are provided at the five predetermined engine rotational speed values Ne1–Ne5 and applied when the atmospheric pressure is equal to or higher than a first predetermined atmospheric pressure value $P_{A1}$ (e.g., 680 mmHg), and five $P_{BACAT2}$ values, which are larger than the corresponding $P_{BACAT1}$ values, are also set at the five predetermined engine rotational speed values Ne1–Ne5 and applied when the atmospheric pressure is equal to or lower than a second predetermined value $P_{A2}$ (e.g., 600 mmHg) which is lower than the first predetermined value $P_{A1}$. When the actual engine rotational speed lies between adjacent ones of the five values Ne1–Ne5, the predetermined value $P_{BACAT}$ is determined by an interpolation method using the actual engine rotational speed. When the atmospheric pressure $P_A$ lies between the first and second predetermined value $P_{A1}$ and $P_{A2}$, the predetermined value $P_{BACAT}$ is determined by an interpolation method using the actual atmospheric pressure $P_A$.

The reason for setting the predetermined value $P_{BACAT}$ such that the higher the engine rotational speed Ne the larger the value $P_{BACAT}$ is that the higher the engine rotational speed Ne the higher the flow speed of intake air and accordingly the smaller amount of fuel adheres to the inner wall of the intake pipe, etc. On the other hand, the reason for setting the predetermined value $P_{BACAT}$ such that the lower the atmospheric pressure $P_A$, i.e., the higher the altitude at which the vehicle is running, the larger the value $P_{BACAT}$ is that at a high altitude the weight or density of intake air is smaller than at a low altitude so that excessive rise of the temperature of the three-way catalyst takes place at higher load operation of the engine 1.

Referring again to FIG. 3, if the answer to the question of the step 301 is affirmative or Yes, that is, if the absolute pressure $P_{BA}$ has continually been equal to or higher than the predetermined value $P_{BACAT}$ over the first predetermined time period $t_{WOTCAT}$, and accordingly it is presumed that a large amount of fuel adheres to the inner wall of the intake pipe, etc., the $t_{CAT}$ timer or down counter is started to count a second predetermined time period $t_{CAT}$ (e.g., 6 seconds) at a step 302, and then the program proceeds to a step 304, hereinafter described. If the answer to the question of the step 301 is negative or No, that is, if $P_{BA}$ has not continually been equal to or higher than $P_{BACAT}$ over the first predetermined time period $t_{WOTCAT}$, and accordingly it is assumed that a large amount of fuel is not on the inner wall of the air intake pipe, etc., the tCAT timer has its counted value set to 0 at a step 303. Then, first and second flags $F_{tCAT1}$ and $F_{tCAT2}$, which are applied, respectively, to determinations at steps 209 and 217, are both set to 0 at the step 304, followed by terminating the subroutine.

Referring again to FIG. 2, at a step 208 following the above step 206, it is determined whether or not the mixture-leaning coefficient $K_{LS}$ is smaller than 1.0, that is, whether or not the engine 1 is in the mixture leaning region or low-load operating region. If the engine 1 is not in the mixture leaning region and accordingly it is in the feedback control region, it is determined whether the above first flag $F_{tCAT1}$ is equal to 1 or not at a step 209. If the answer to the question of the step 209 is affirmative or Yes, the second flag $F_{tCAT2}$ is set to 1 at a step 210, whereas if the answer is negative or No, the second flag $F_{tCAT2}$ is set to 0 at a step 211, and then the program proceeds to a step 212.

At the step 212, the engine coolant temperaturedependent correction coefficient $K_{TW}$ and the after-start fuel increasing coefficient $K_{AST}$ are both set to 1 to prohibit fuel increasing correction by these correction coefficients, and then feedback control is executed at a next step 213, followed by terminating the program. In the feedback control at the step 213, the $O_2$-feedback correction coefficient $K_{O2}$ is calculated in response to the output of the $O_2$ sensor 14 to thereby bring the air-fuel ratio of the mixture supplied to the engine 1 to a desired predetermined value (e.g., 14.7), and at the same time an average value $K_{REF}$ of the coefficient $K_{O2}$ is calculated.

If the answer to the question of the step 208 is affirmative or Yes, that is, if $K_{LS}<1.0$ is satisfied and accordingly the engine 1 is in the mixture leaning region, it is determined at a step 214 whether or not the counted value $t_{CAT}$ of the aforementioned timer $t_{CAT}$ is equal to 0. If the answer is negative or No, that is, if the counted value $t_{CAT}$ is not equal to 0, which means that $P_{BA}>P_{BACAT}$ continued over the first predetermined time period $t_{WOTCAT}$ but the second predetermined time period $t_{CAT}$ has not elapsed after the engine 1 left the wide-open-throttle region, it is determined at a step 215 whether or not the speed V of a vehicle in which the engine is installed is higher than a predetermined value $V_{CAT}$ (e.g., 19.2 km/h), and then at a step 216 whether or not the engine rotational speed Ne is higher than a predetermined value $N_{CAT}$, (e.g., 2,800 rpm). The above steps 215 and 216 are for discriminating whether the three-way catalyst 13 is in a hot state or not. If the answers to the questions of the steps 215 and 216 are both affirmative or Yes, tat is, if $V>V_{CAT}$ and $Ne>N_{CAT}$ are satisfied at the same time, it is assumed that the three-way catalyst is hot, and then it is determined at a step 217 whether the second flag $F_{tCAT2}$ is equal to 1 or not. If the answer to the question of the step 217 is negative or No, the $t_{CAT}$ timer is reset to the second predetermined time period $t_{CAT}$ and started again at a step 218, then at a step 219 the first flag $F_{tCAT1}$ is set to 1, and thereafter the aforementioned steps 212 and 213 are executed to effect feedback control of the air-fuel ratio, followed by terminating the program.

As described above, according to the invention, when the state of $P_{BA}>P_{BACAT}$ continued over the predetermined time period $t_{WOTCAT}$, and the engine 1 leaves the wide-open-throttle region and shifts to the mixture leaning region before the lapse of the second predetermined time period $t_{CAT}$, the feedback control is effected even in the mixture leaning region. This feedback control positively prevents overriching of the mixture supplied to the engine 1, which was conventionally caused by suction of the fuel adhering to the intake pipe inner wall, etc. into the combustion chambers.

When the engine 1 shifts from the wide-open-throttle region to the mixture leaning region through the feedback control region, the second flag $F_{tCAT2}$ is set to 0 by executing the step 304 of the subroutine of FIG. 3 and the steps 209 and 211 of the present control program, and accordingly the $t_{CAT}$ timer is repeatedly set and started at the steps 217 and 218. Therefore, as long as the engine 1 is in the mixture leaning region, the answer to the question of the step 214 is negative or No, thereby repeatedly effecting the feedback control.

Further, in the case where the engine 1 once shifts from the mixture leaning region to the feedback control region and soon again returns to the mixture leaning region, e.g., when the accelerator pedal is depressed for a brief time period in the mixture leaning region, the first flag $F_{tCAT1}$ is set to 1 by executing the step 219 in the mixture leaning region, and the second flag $F_{tCAT2}$ is set to 1 by executing the steps 209 and 210 in the feedback control region so that when the engine 1 returns to the mixture leaning region, the answer to the question of the step 217 is affirmative or Yes and accordingly the step 218 is not executed. Consequently, the feedback control is uninterruptedly continued after the engine 1 first shifts from the mixture leaning region and until the lapse of the second predetermined time period $t_{CAT}$, thereby preventing overriching of the mixture.

On the other hand, if the answer to the question of the step 214 is affirmative or Yes, that is, if $t_{CAT}=0$ is satisfied, specifically, if $P_{BA}>P_{BACAT}$ did not continue over the first predetermined time period $t_{WOTCAT}$ or if the second predetermined time period $t_{CAT}$ has elapsed after the engine 1 left the wide-open-throttle region, it is assumed that a large amount of fuel no longer remains on the inner wall of the air intake pipe, etc. Consequently, the program proceeds to the steps 220 et seq. to effect open-loop control for leaning the mixture by using the mixture-leaning coefficient KLS.

To be specific, at the step 220 the first flag $F_{tCAT}$ is set to 0, and the $t_{CAT}$ timer has its counted value set to 0 at a step 221. Then, it is determined at a step 223 whether or not the loop of the steps 220 et seq. has repeatedly been executed over a predetermined time period $T_D$ (e.g., 0.5 seconds). If the answer is negative or No, the $O_2$-feedback correction coefficient $K_{O2}$ is maintained at a value obtained in the last loop to thereby effect open-loop control at a step 224. On the other hand, if the answer is affirmative or Yes, the $O_2$-feedback correction coefficient $K_{O2}$ is set to the average value $K_{REF}$ calculated during feedback control, to thereby effect open-loop control at a step 225, then terminating the program. The above predetermined time period $T_D$ serves to prevent a transient change in the air-fuel ratio at transition from the feedback control region to the open-loop control region.

If one of the answers to the questions of the steps 215 and 216 is negative or No, that is, if either $V \leqq V_{CAT}$ or $Ne \leqq N_{CAT}$ is satisfied, it is assumed that the three-way catalyst 13 is not in a hot state and hence there is almost no possibility of after-fire. Therefore, open-loop control is effected for leaning the mixture, by using the mixture-leaning coefficient $K_{LS}$.

FIG. 5 shows a subroutine for calculating an amount of electric current $I_{DEC}$ to be supplied to the auxiliary air control valve 19, which is executed upon generation of each pulse of the TDC signal.

First, it is determined at a step 501 whether or not the throttle opening $\theta_{TH}$ is smaller than a mixture-leaning discriminating value $\theta_{LS}$. If the answer is negative or No, or if $\theta_{TH} \geqq \theta_{LS}$ is satisfied and hence the engine 1 is in the feedback control region, not in the mixture leaning region, a $t_{IDEC2}$ timer formed by a down counter is started to count a predetermined time period $t_{IDEC2}$, e.g., 2 seconds, at a step 502, and then an $I_{DEC(A)}$ table is selected from among $I_{DEC}$ tables at a step 503 to thereby calculate the amount of current $I_{DEC}$, then terminating the program.

Figure 6:
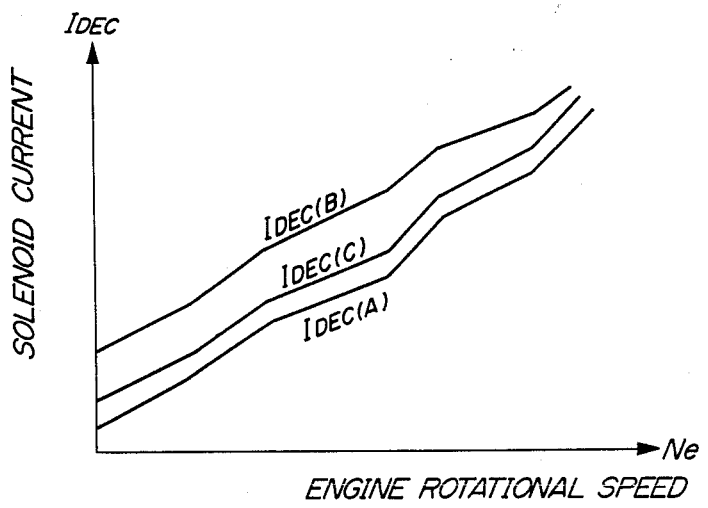
FIG. 6 is a graph showing $I_{DEC}$ tables to be selected by the subroutine of FIG. 5.

FIG. 6 shows an example of the $I_{DEC}$ tables, wherein three tables are provided, i.e., $I_{DEC(A)}$, $I_{DEC(B)}$, and $I_{DEC(C)}$. In each table, the amount of current $I_{DEC}$ is set such that it increases with increase of the engine rotational speed Ne. The relationship between the tables is $I_{DEC(A)}<I_{DEC(B)}<I_{DEC(C)}$ at the same engine rotational speed Ne.

When the engine 1 is in the feedback control region, the steps 501 and 503 in FIG. 5 are executed to set the amount of current $I_{DEC}$ to the smallest value, e.g., a value based on the table $I_{DEC(A)}$ of FIG. 6, thus supplying the smallest amount of auxiliary air to the engine 1.

On the other hand, if the answer to the question of the step 501 is affirmative or Yes, that is, if $\theta_{TH}<\theta_{LS}$ is satisfied and hence the engine 1 is in the mixture leaning region, it is determined at a step 504 whether or not the counted value $t_{CAT}$ of the $t_{CAT}$ timer is equal to 0. If the answer is affirmative or Yes, that is, if $t_{CAT}=0$ is satisfied, it is assumed that the amount of fuel adhering to the inner wall of the intake pipe, etc. is not so large and then the steps 502 and 503 are executed to supply the smallest amount of auxiliary air to the engine 1.

If the answer to the question of the step 504 is negative or No, that is, if the counted value $t_{CAT}$ is not equal to 0 and hence the feedback control is being effected by the control program of FIG. 2, it is determined at a step 505 whether or not the table $I_{DEC(C)}$ was selected from among the $I_{DEC}$ tables in the last loop. If the answer is negative or No, it is determined whether or not the counted value $t_{IDEC2}$ of the $t_{IDEC2}$ timer, which has been started at the step 502, is equal to 0, at a step 506. This determination is for discriminating whether the absolute pressure within the intake pipe $P_{BA}$, which is compared at a step 508, hereinafter described, is in a stable state or not. If the answer is negative or No, that is, if the counted value $t_{IDEC2}$ is not equal to 0, the table $I_{DEC(B)}$ is selected at a step 507 and the amount of electric current $I_{DEC}$ is calculated based upon the selected table $I_{DEC(B)}$, followed by terminating the program.

Figure 7:
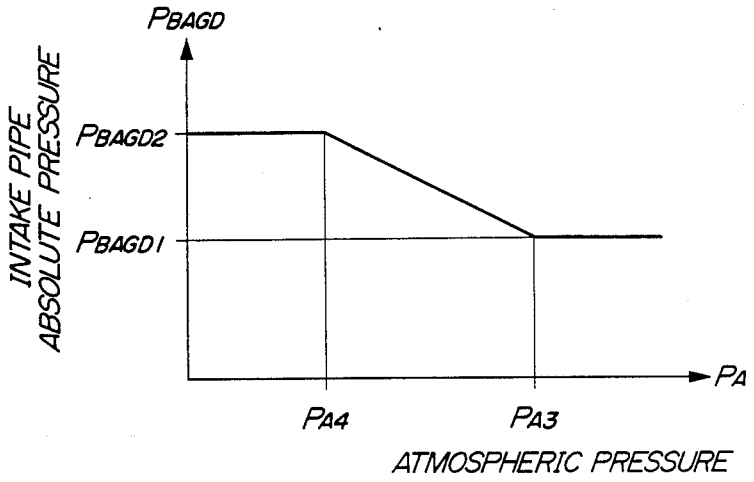
FIG. 7 is a graph showing a table of the relationship between a predetermined value $P_{BAGD}$ and atmospheric pressure $P_A$, which is applied to the subroutine of FIG. 5.
Figure 8:
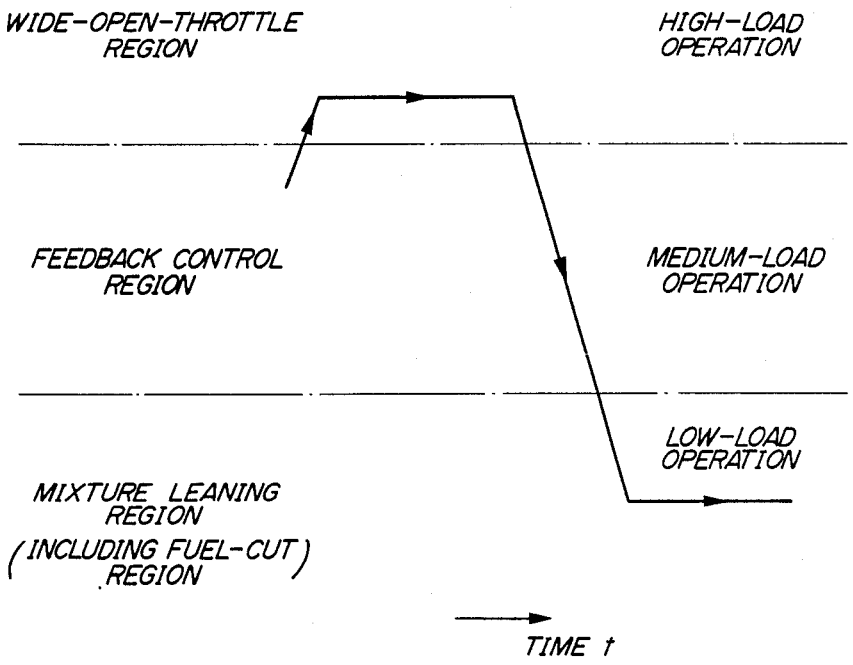
FIG. 8 is a diagram showing the relationship between different engine-load operating conditions of the engine and air-fuel ratio control regions, applied at transition of the engine from a high load operating condition to a low load one.

If the answer to the question of the step 506 is affirmative or Yes, that is, if $t_{IDEC2}=0$ is satisfied, it is determined at the step 508 whether the intake pipe absolute pressure $P_{BA}$ is higher than a predetermined value $P_{BAGD}$. The predetermined value $P_{BAGD}$ represents intake pipe absolute pressure assumed with no load on the engine 1, which may be set based upon a $P_{BAGD}$ table shown in FIG. 7, for example, depending upon the atmospheric pressure $P_A$. Specifically, the predetermined value $P_{BAGD}$ is set to a first predetermined value $P_{BAGD1}$ (e.g., 161 mmHg), when the atmospheric pressure is higher than a first predetermined value $P_{A3}$, while it is set to a second predetermined value $P_{BAGD2}$ (e.g., 191 mmHg), which is higher than the first predetermined value $P_{BAGD1}$, when the atmospheric pressure is lower than a second predetermined value $P_{A4}$. When the atmospheric pressure falls between the first and second predetermined values $P_{A3}$ and $P_{A4}$, the value $P_{BAGD}$ is determined by an interpolation method.

Referring again to FIG. 5, if the answer to the question of the step 508 is negative or No, that is, if $P_{BA} \leqq P_{BAGD}$ is satisfied, the step 507 is executed to select the table $I_{DEC(B)}$ for supplying a large amount of auxiliary air to the engine 1, whereas if the answer is affirmative or Yes, that is, if $P_{BA}>P_{BAGD}$ is satisfied, the table $I_{DEC(C)}$ is selected at a step 509, thereby supplying a medium amount of auxiliary air to the engine 1.

In this way, when the engine 1 is in the mixture leaning region, a large amount of auxiliary air is supplied to the engine 1 to thereby cause the fuel adhering to the engine intake pipe, etc. to be carried by the air into the engine combustion chambers for enhancing combustion therein. Further, even if the absolute pressure $P_{BA}$ within the engine intake pipe is increased by the supply of auxiliary air, it is maintained at or below a value of intake pipe absolute pressure assumed with no load on the engine 1, so as to lower the engine rotational speed Ne for securing a desired decelerating state of the engine 1.

If the answer to the question of the step 505 is affirmative or Yes, that is, if the table $I_{DEC(C)}$ was selected in the last loop, the step 509 is executed to thereby select the same table. Thus, once the table $I_{DEC(C)}$ has been selected, it is continually selected thereafter, thus positively preventing the intake pipe absolute pressure $P_{BA}$ from increasing, i.e., varying toward higher load on the engine 1.

What is claimed is:

1. A method of controlling the air-fuel ratio of a mixture of fuel supplied to an internal combustion engine having an exhaust system and an exhaust-gas concentration sensor provided in said exhaust system, wherein feedback control is effected in response to an output from said exhaust-gas concentration sensor to bring the air-fuel ratio to a predetermined value when said engine is in a predetermined medium-load operating region, the method comprising the steps of:

(1) determining whether or not said engine is in a predetermined high-load operating region in which the feedback control is interrupted for bringing the air-fuel ratio to a value smaller than said predetermined value;

(2) determining whether or not said engine is in a predetermined low-load operating region in which the feedback control is interrupted for bringing the air-fuel ratio to a value larger than said predetermined value; and (3) effecting the feedback control even when said engine is in said predetermined low-load operating region, if said engine continually stayed over a first predetermined time period in said predetermined high-load operating region, and has shifted to said low-load operating region within a second predetermined time period after leaving said predetermined high-load operating region.

2. A method as claimed in claim 1, wherein said engine has an intake passage, and said step (3) is executed when pressure within said intake passage was continually equal to or higher than a predetermined value over said first predetermined time period in said predetermined high-load operating region.

3. A method as claimed in claim 2, wherein said predetermined value of said pressure within said intake passage is determined by the rotational speed of said engine.

4. A method as claimed in claim 2 or claim 3, wherein said predetermined value of said pressure within said intake passage is determined by atmospheric pressure.

5. A method as claimed in claim 1 or claim 2, wherein the feedback control in said step (3) is continued until said second predetermined time period elapses.

6. A method as claimed in claim 1, wherein the feedback control in said step (3) is effected in said predetermined low-load operating region when the speed of a vehicle in which said engine is installed is higher than a predetermined value.

7. A method as claimed in any of claims 1 to 3 or 6, wherein the feedback control in said step (3) is effected in said predetermined low-load operating region when the rotational speed of said engine is higher than a predetermined value.

8. A method as claimed in claim 1, wherein said engine includes means for additionally supplying auxiliary air thereto, and said step (3) includes a step (3a) for supplying auxiliary air to said engine in a predetermined amount larger than an amount supplied in said predetermined medium-load operating region after said engine shifts to said predetermined low-load operating region.

9. A method as claimed in claim 8, wherein said step (3a) is executed over a third predetermined time period after said engine leaves said predetermined high-load operating region.

10. A method as claimed in claim 8 or claim 9, wherein said predetermined amount of auxiliary air is determined by the rotational speed of said engine.

11. A method as claimed in claim 8 or claim 9, wherein said engine has an intake passage, and auxiliary air is supplied in said predetermined amount to said engine when pressure within said intake passage is lower than a predetermined value after the lapse of said third predetermined time period.

12. A method as claimed in claim 11, wherein said predetermined value of said pressure within said intake passage is determined by atmospheric pressure.

* * * * *